US006084185A

United States Patent [19]

Bachle

[11] Patent Number: 6,084,185

[45] Date of Patent: Jul. 4, 2000

[54] SAFETY SWITCH

[75] Inventor: Erik Bachle, Filderstadt, Germany

[73] Assignee: Euchner GmbH & Co., Leinfelden-Euchterdingen, Germany

[21] Appl. No.: 09/308,489

[22] PCT Filed: Nov. 20, 1997

[86] PCT No.: PCT/EP97/06478

§ 371 Date: May 20, 1999

§ 102(e) Date: May 20, 1999

[87] PCT Pub. No.: WO98/25284

PCT Pub. Date: Jun. 11, 1998

[30] Foreign Application Priority Data

Nov. 30, 1996 [DE] Germany ..... 196 49 717

[51] Int. Cl.[7] ..... H01H 3/16; H01H 27/00

[52] U.S. Cl. ..... 200/43.07; 200/17 R; 200/61.62

[58] Field of Search ..... 200/17 R, 43.01, 200/43.04–43.09, 61.62–61.68, 334

[56] References Cited

U.S. PATENT DOCUMENTS

| | | | |
|---|---|---|---|
| 4,963,706 | 10/1990 | Mohtasham | 200/334 |
| 5,516,993 | 5/1996 | Wecke et al. | 200/17 R |
| 5,587,569 | 12/1996 | Mohtasham | 200/17 R |
| 5,622,253 | 4/1997 | Wecke et al. | 200/43.07 |
| 5,703,339 | 12/1997 | Rapp et al. | 200/17 R |
| 5,868,243 | 2/1999 | Bachle | 200/334 |
| 5,898,143 | 4/1999 | DaDalt | 200/17 R |

FOREIGN PATENT DOCUMENTS

| | | | |
|---|---|---|---|
| 0707329A1 | 4/1996 | European Pat. Off. | H01H 27/00 |
| 4039652 | 3/1992 | Germany | H01H 3/20 |
| 4338910 | 2/1995 | Germany | H01H 13/18 |
| 4408024 | 9/1995 | Germany | H01H 27/00 |
| 9633504 | 10/1996 | WIPO | H01H 27/00 |

*Primary Examiner*—Michael Friedhofer
*Attorney, Agent, or Firm*—Roylance, Abrams, Berdo & Goodman, L.L.P.

[57] ABSTRACT

A safety switch includes a switch housing having at least one key channel into which a key can be introduced from the exterior. A plate cam projects into key channel and rotates when the key is introduced. A mechanism in secures the plate cam when the key has been fully introduced or completely removed.

15 Claims, 2 Drawing Sheets

SAFETY SWITCH

FIELD OF THE INVENTION

The present invention relates to a safety switch having a switch housing with at least one key passage for receiving a key from exterior of the switch housing and with a plate cam rotatably mounted in the switch housing. Upon introduction of the key in the key passage, the key rotates the plate cam.

BACKGROUND OF THE INVENTION

Safety switches, such as disclosed in DE 44 08 024 A1, serve to make the current supply feeding electrical machinery dependent upon whether certain protection devices, which are integral with the machine, are positioned in the correct setting. With some embodiments, the safety switch does not connect the control current circuit supplying a current supply to the machine because the protection devices have greater tolerances than allowed by the safety switch.

EP-A1-0 707 329 discloses a safety switch with a plate cam mounted rotatably on an axis on which are arranged interlocking means. The interlocking means lock or secure the plate cam when the key is not introduced and are thrust out of their blocking position when the key is introduced. The plate cam is released with further introduction of the key, with the interlocking means being rotated together with the plate cam.

SUMMARY OF THE INVENTION

Objects of the present invention are to provide an improved safety switch in which the plate cam is prevented from rotating as a result of machine vibrations when the key is in or out of the key passage.

The foregoing objects are basically obtained by a safety switch comprising a switch housing, a first key passage in the switch housing, a key receivable in the key passage from a location exterior of the switch housing, and a plate cam projecting into the key passage and rotatable in the switch housing about a rotational axis upon introduction of the key. Securing means in the switch housing secures the plate cam against rotation when the key is completely introduced into the key passage and when the key is completely outside the key passage. It also allows the key to be introduced deeper into the key passage after the plate cam is secured by the securing means.

By securing the plate cam when the key is completely inserted, the plate cam is prevented from rotating as a result of vibrations of the machine occurring during key insertion, so that the key can no longer be pulled out. The key is inserted to a certain depth of introduction following termination of the rotary displacement of the plate cam. Since the securing means allows the plate cam to permit a deeper introduction of the key, in other words allowing for a "track alignment arrangement" of greater length, even imprecise switch-throwing protection devices can be reliably controlled. In advantageous embodiments, the plate cam is secured even when the key is not inserted.

In one preferred embodiment, the means for securing the plate cam are realized by the plate cam having at least one recess which cooperates with a blocking element movable relative to the plate cam.

The recess can be provided, for example, in an additional material part constructed on the side of the plate cam. The blocking element can be arranged on one side of the plate cam and constructed and shaped in conformation with a movable interlocking member. With this embodiment, parts can be used which are already present in known safety switches. This reduces the number of new required parts and reduces the required modifications of the tools. One especially space-saving embodiment is obtained when the interlocking member can be movable perpendicular to the rotary axis of the plate cam.

The recess and blocking element can also be realized, for example, in such a manner that the recess is provided in an area of the plate cam, which with rotation of the plate cam, projects into the key passage. Also the blocking arrangement can be provided as part of the key. An especially simple realization of the blocking element is obtained with a longitudinally slotted, fork-shaped key, and formed by recessed cutout sections provided on the interior of the key slot. The recess is then configured to be groove-like, whereupon the plate cam retains its fracture and break-resistance. The recess could also penetrate the entire thickness of the plate cam, whereby a material part passing all the way through the key could be provided, instead of the recessed cutout sections.

The operational capacity of the safety switch is preferably additionally enhanced in that the securing means are provided for symmetrical securing of both sides of the plate cam.

A broadening of the possibilities of utilization of the safety switch of the present invention is obtained when this switch has two, non-parallel key passages, preferably extending perpendicular to one another, into which the key can be introduced as desired. Operation members can project outward into the key passage when the key is not introduced, and preferably are connected with interlocking members for the securing of the plate cam in this setting and disconnect the plate cam upon introduction of the key. The number of required component parts is reduced in a simple manner, when such operation member can be displaced along an angle-bisecting line bisecting the two key passages and can project simultaneously into both key passages. Another advantageous reduction of the number of component parts is attained when the operation member is configured simultaneously as an interlocking member.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1A:
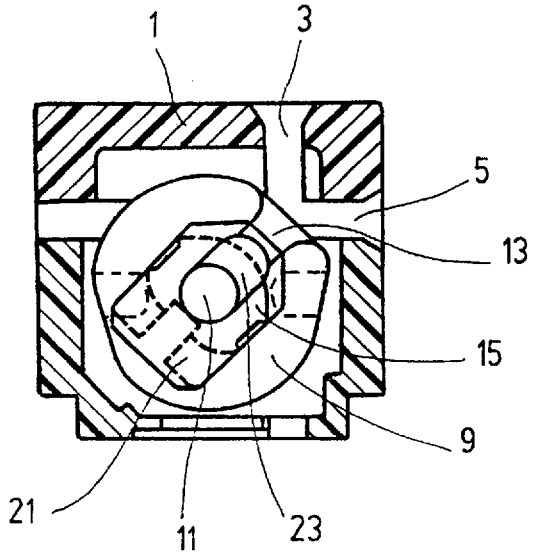
FIGS. 1A to 1C are side elevational views in section of a safety switch according to a first embodiment of the present invention, with the key introduced to different degrees.
Figure 1B:
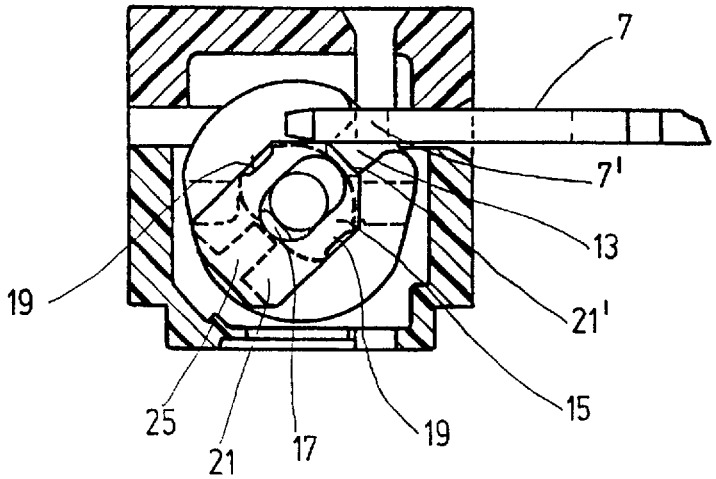
Figure 1C:
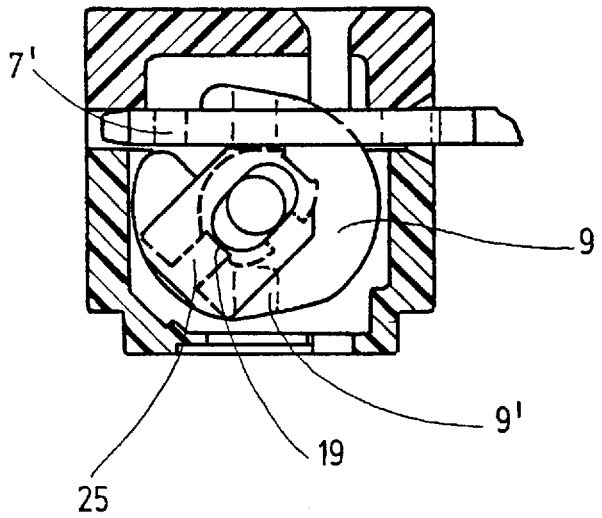

In the first embodiment of the safety switch of the present invention, the switch housing 1 of the working mechanism shown in the drawing has a first key passage 3 extending longitudinally through the switch housing. An additional or second key passage 5 is provided in the working mechanism of switch housing 1, and extends perpendicularly to first key passage 3. A key 7 can be introduced from the exterior into either one of the two key passages 3 or 5, as desired. A plate cam 9 is mounted rotatably within the working mechanism of switch housing 1. The plate cam rotary axis 11 extends perpendicular both to first key passage 3 and to second key passage 5. Plate cam 9 projects into both key passages 3 and 5.

At a point lying in the intersecting area of the two key passages 3 and 5 when the key is not introduced therein, plate cam 9 has a short groove 13 extending radially outwardly on each side. Key 7 is configured with a fork-like end so as to be introduced into a key passage 3 or 5. On the exterior of each of the two ends of key 7, a partial crossbar 7' is provided. With the introduction of key 7 into one of the two key passages 3 or 5, the partial cross bar engages in one of the grooves 13, and thereby carries plate cam 9 along with it in the direction of continued introduction of key 7. This results in a rotary displacement of plate cam 9.

A punch (not shown) engages slidably in a longitudinal direction in the switch housing. At the other end of this punch, a switch is provided in switch housing 1, which is likewise not shown. With rotary displacement of plate cam 9 caused by introduction of key 7, the plate cam thrusts the punch and thus proactively operates the switch.

On each of the two sides of plate cam 9, in the area of rotary axis 11, an oval material part 15 is shaped on the plate cam. Each of the two identically configured material parts 15 has a groove-like first recess 17 arranged opposite and radially facing groove 13 in relation to rotary axis 11, as well as two more likewise groove-like recesses 19 offset by 90° from first recess 17. The additional recesses 19 are located at the two pointed ends of oval material part 15, while first recess 17 is provided on one longitudinal side.

An interlocking member 21, is provided, in turn, on each side of plate cam 9 in addition to the material parts 15 of the plate cam, and extends in an axial direction. Each interlocking member 21 has an oblong-shaped opening 23 surrounding rotary axis 11. By means of guides in the switch housing, but not shown in the drawing, the single possible direction of displacement of interlocking member 21 is determined. That direction is perpendicular to rotary axis 11, and at the same time is in the direction of oblong-shaped opening 23. This direction of displacement is aligned with the intersecting point of the two key passages 3 and 5, and extends along a line bisecting the angles of the two passages.

In other words, that displacement direction is offset 45° from the two key passages. An end 21' of interlocking member 21 is aligned on this intersecting point. At the other end more distance from this intersecting point, interlocking member 21 is supported by means of a spring, not shown in the drawing, mounted on switch housing 1. On the side closer to the plate cam 9, interlocking member 21 has an elevated locking tooth or ratchet 25. Ratchet 25 can engage form-fitting both in first recess 17 and also in the other recesses 19 of material part 15 of plate cam 9. The possible degrees of engagement in the case of the other recesses 19 are thus smaller than with first recess 17. The end 21' aligned on the intersecting point of key passages 3 and 5 projects into both first key passage 3 and second key passage 5. This end 21' of interlocking member 21, while serving simultaneously as an operating member, is configured as a ramp for key 7.

When key 7 is located exterior to key passages 3 and 5, plate cam 9 is aligned such that groove 13 is at the intersecting point of key passages 3 and 5. Because of the spring force loading interlocking member 21, interlocking member 21 engages rotary axis 11 at the end of oblong-shaped opening 23 further away from the point of the passage intersection. Simultaneously, locking tooth 25 engages in recess 17 of material part 15.

When key 7 is introduced into one of the two key passages 3 or 5, the key initially strikes against end 21' of interlocking member 21 serving as a ramp for the key. This striking forces interlocking member 21 back counter to the spring force, in other words out of key passage 3 and 5. Simultaneously, locking tooth 25 is released from first recess 17. With further introduction of key 7, its partial crossbars 71, each of which is turn engages a groove 13, also displace plate cam 9. Simultaneously, material part 15 continues its movement with its periphery engaging locking tooth 25. Because of the eccentricity of material part 15, interlocking member 21 is displaced even further out of key passage 3 or 5 than key 7 has the capacity to displace the interlocking member.

When key 7 is introduced completely, in other words shortly before partial cross bars 7' would again be displaced from grooves 13, locking tooth 25 drops into one of the other recesses 19. Plate cam 9 is thus secured in this position. The spring bias effecting interlocking member 21 is sufficient to hold locking tooth 25 in the other recess 19 even during vibration movements. The safety switch of the present invention can be configured so that, starting with the plate cam in the secured position, key 7 can be introduced further into key passage 3 or 5 in the sort of track alignment arrangement, and partial crossbars 7' then leave grooves 13 once again.

With the removal of key 7, the force exerted through plate cam 9 by its material part 15 on locking tooth 25 becomes so intensive that locking tooth 25 is pressed out of the other recess 19. This action frees plate 9 for rotary displacement.

In the second exemplary embodiments of the safety switch of the present invention, a switch housing 101 is likewise provided with a key passage 105. A longitudinally slotted, fork-like key 107 can be introduced into key passage 105. A plate cam 109 which projects into key passage 105 is rotated with introduction of key 107 in such a manner that partial crossbars 107' of key 107 engage in grooves 113, which are provided on both sides of plate cam 109. A material part 115 is shaped around the rotary axis 111 of plate cam 109, and is integral with plate cam 109. Part 115 is shaped with a flank 117.

Directly adjacent to each material part 115, an interlocking member 121 is provided. Interlocking member 121 has an oblong-shaped opening 123 surrounding the rotary axis 111, as is illustrated only in FIG. 2A. Interlocking member 121 is movable perpendicular to key passage 105, and is supported by means of a spring not shown. A locking tooth 125 provided on the interior of interlocking member 121 engages on the flank part 117 of material part 115, when key 107 is located exterior to key passage 105.

Around the border or periphery of plate cam 109, groove-like recesses 119 are provided on both sides. Recesses 119 extend perpendicular to the radial direction and open at one end on the periphery of plate cam 109. With rotation of plate cam 109, this border or peripheral area can reach into key passage 105.

Figure 2A:
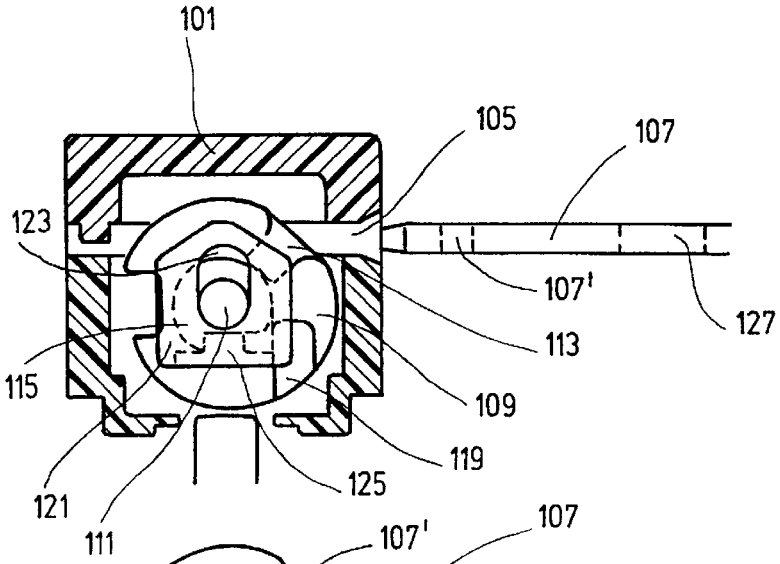
FIGS. 2A to 2C are side elevational views in section of a safety switch according to a second embodiment of the present invention with the key introduced to different degrees.
Figure 2B:
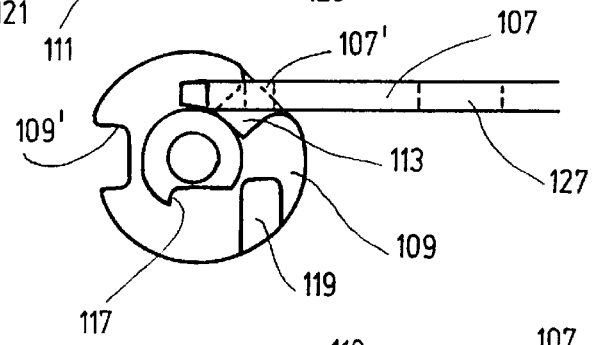
Figure 2C:
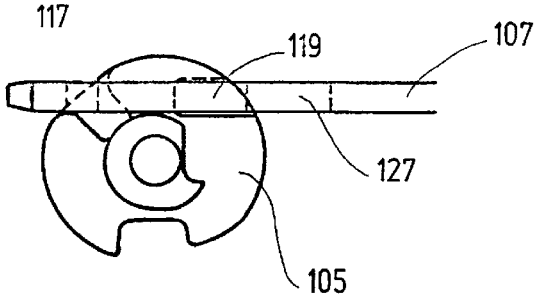
Figure 3:
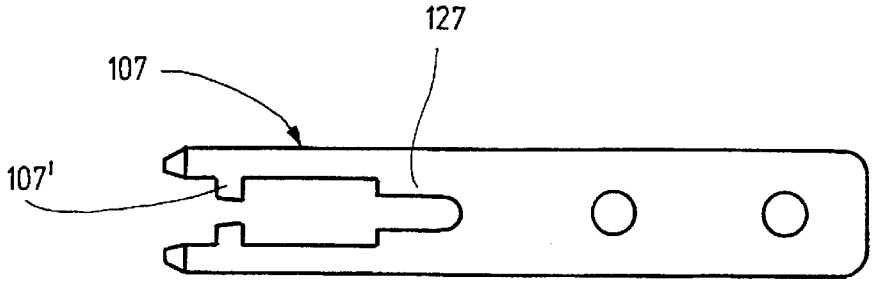
FIG. 3 is a top plan view of the key of FIGS. 2A to 2C.

When key 107 is introduced into key passage 105, the point of the key presses or forces interlocking member 121 back counter to the bias of its spring, whereby locking tooth 125 is then released from flank 117. Partial crossbars 107' of key 107 carry along plate cam 109 by displacing it until partial crossbars 107' are located behind plate cam 109, as viewed from the direction of introduction. Plate cam 109 moves a punch device as indicated in FIG. 2A, which in turn operates the switch. In the arrangement in which partial cross bars 107' are located to the rear of plate cam 109, the groove-like recesses 119 are aligned along key passage 105, as shown in FIG. 2C. Key 7 can then be introduced further into key passage 105 by means of a sort of a track alignment arrangement, whereby recessed cutout sections 127 provided on the interior of key 107 engage in the groove-like recesses 119 to secure plate cam 109.

While various embodiments have been chosen to illustrate the invention, it will be understood by those skilled in the art that various changes and modifications can be made therein without departing from the scope of the invention as defined in the appended claims.

What is claimed is:

1. A safety switch, comprising:

a switch housing:

a first key passage in said switch housing;

a key receivable in said key passage from a location exterior of said switch housing;

a plate cam projecting into said key passage and rotable in said switch housing about a rotational axis upon introduction of said key; and securing means in said switch housing for securing said plate cam against rotation when said key is completely introduced into said key passage, and for allowing said key to be introduced deeper into said key passage after said plate cam is secured by said securing means.

2. A safety switch according to claim 1 wherein said securing means secures said plate cam when said key is not introduced into said switch housing.

3. A safety switch according to claim 1 wherein said securing means comprises at least one recess and a cooperating blocking element movable relative to said plate cam.

4. A safety switch according to claim 3 wherein said blocking element is movable in a radial direction relative to said rotational axis, and is spring biased against said plate cam.

5. A safety switch according to claim 4 wherein said at least one recess is provided in one side of a shaped material part on said plate cam; and an interlocking member is arranged on one side of said plate cam and includes said blocking element.

6. A safety switch according to claim 5 wherein said interlocking member comprises an oblong-shaped opening surrounding said rotational axis of said cam plate.

7. A safety switch according to claim 6 wherein said interlocking member is movable perpendicular to said rotational axis of said plate cam.

8. A safety switch according to claim 3 wherein said at least one recess is provided in one side of a shaped material part on said plate cam; and an interlocking member is arranged on one side of said plate cam and includes said blocking element.

9. A safety switch according to claim 8 wherein said interlocking member comprises an oblong-shaped opening surrounding said rotational axis of said cam plate.

10. A safety switch according to claim 9 wherein said interlocking member is movable perpendicular to said rotational axis of said plate cam.

11. A safety switch according to claim 3 wherein said at least one recess is provided in an area of said plate cam projecting into said key passage during rotation of said plate cam; and said blocking element is provided on said key.

12. A safety switch according to claim 11 wherein said at least one recess is configured as a groove; and said key is fork-shaped with a longitudinal slot, said blocking element being formed by recessed cut-out sections on an interior of said longitudinal slot.

13. A safety switch according to claim 1 wherein said securing means are symmetrically provided on both sides of said plate cam.

14. A safety switch according to claim 1 wherein a second key passage extends in said switch housing non-parallel to said first key passage; and an operation member is movable along an angle bisecting said first and second key passages, and projects into said first and second key passages when said key is not introduced into one of said key passages.

15. A safety switch according to claim 14 wherein said operation member is part of an interlocking member.

* * * * *